United States Patent [19]

Hefty et al.

[11] 4,213,212

[45] Jul. 22, 1980

[54] ARRANGEMENT FOR FITTING AND CHANGING A TUBULAR COVER MADE OF PLASTIC FILM ON A TOILET SEAT, AND METHOD FOR FORMING A TUBE

[75] Inventors: Bela Hefty, Sursee; Arpad Hefty, Manensee, both of Switzerland

[73] Assignee: Hygomat AG, Switzerland

[21] Appl. No.: 938,351

[22] Filed: Aug. 31, 1978

[30] Foreign Application Priority Data

Sep. 7, 1977 [CH] Switzerland ..... 10935/77
Nov. 4, 1977 [CH] Switzerland ..... 13426/77

[51] Int. Cl.[2] ..... A47K 13/14; A47K 13/20; A47K 13/22

[52] U.S. Cl. ..... 4/243; 4/247

[58] Field of Search ..... 4/247, 242–246

[56] References Cited

U.S. PATENT DOCUMENTS

| | | | |
|---|---|---|---|
| 887,686 | 5/1908 | Morrison | 4/247 |
| 912,280 | 2/1909 | Brott | 4/247 |
| 1,237,548 | 8/1917 | Palmer | 4/247 |
| 1,487,448 | 3/1924 | Duarte | 4/247 |
| 1,589,429 | 6/1926 | Rouse | 4/247 |
| 1,858,794 | 5/1932 | Vallacchi | 4/247 |
| 1,954,139 | 4/1934 | Lundin | 4/247 |
| 2,189,562 | 2/1940 | Doerr | 4/247 X |
| 2,243,134 | 5/1941 | Stiller | 4/247 |
| 3,271,792 | 9/1966 | Tromp | 4/247 |
| 4,106,135 | 8/1978 | Mannheim | 4/247 |

FOREIGN PATENT DOCUMENTS

| | | | |
|---|---|---|---|
| 110102 | 2/1928 | Austria | 4/247 UX |
| 7000474 | 1/1970 | Fed. Rep. of Germany | 4/247 UX |
| 1554585 | 4/1970 | Fed. Rep. of Germany | 4/247 UX |
| 2505855 | 8/1976 | Fed. Rep. of Germany | 4/247 UX |

*Primary Examiner*—Henry K. Artis
*Attorney, Agent, or Firm*—Browdy and Neimark

[57] ABSTRACT

A tubular toilet seat cover is stored on a reel and pulled off from this reel as it is replaced, and the used cover is taken up on another reel. By actuating a drive mechanism, the cover is moved through a predetermined distance in such manner that when it is in the mounted position, the toilet seat body is surrounded by the tubular cover and the cover covers the important part of the toilet seat. The toilet seat, drive mechanism and storage device constitute a structural unit which is mountable as a whole on a conventional toilet seat, or it may constitute a unit with a toilet seat.

21 Claims, 23 Drawing Figures

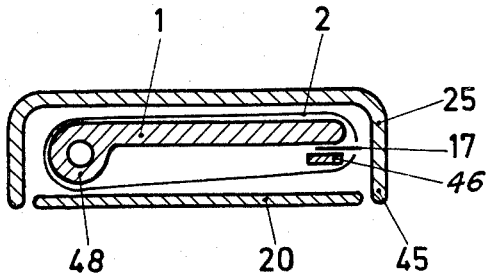
FIG.18
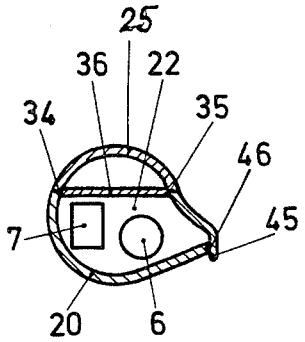
FIG.19
FIG.20
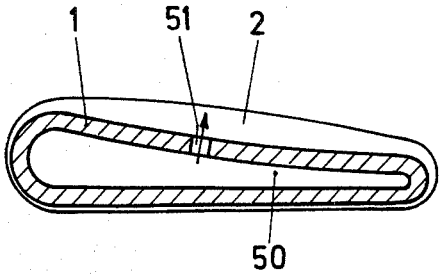
FIG.22
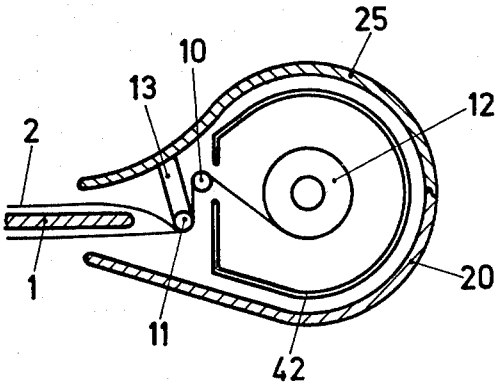
FIG. 21
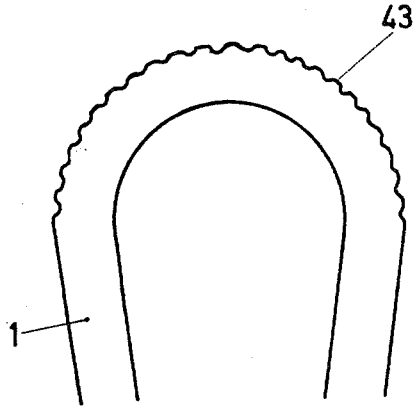

ARRANGEMENT FOR FITTING AND CHANGING A TUBULAR COVER MADE OF PLASTIC FILM ON A TOILET SEAT, AND METHOD FOR FORMING A TUBE

FIELD OF INVENTION

The present invention relates to an arrangement for fitting and changing a tubular cover of plastic film on a toilet seat, whereby the cover is stored and pulled off from a container during changing and wound up again in another container, as well as a method for forming such a tubular cover.

BACKGROUND OF INVENTION

Toilet seats for toilets, with a device for hygienic covering by a film, are known (German Offenlegungsschrift No. 2,505,855). The toilet seats has a V-shaped design, opening toward its pivot. Devices to accept the covering film are mounted on the right and left on the open side of the seat.

Moreover, toilet seats with automatically changing covers made of plastic film constitute the state of the art (German Offenlegungsschrift No. 1,554,585). After each toilet use, this cover can be wound up for a distance corresponding to the width of the seat without touching it with the hands. This ensures that there is always a hygienic and clean cover over the entire seat, with the exception of the central opening.

Fifty years ago, an attempt was made to cover a horseshoe-shaped toilet seat with a paper cover (Austrian Pat. No. 110,102). However, the arrangement was unable to meet the requirements imposed upon it, either from the hygienic or technical standpoint (for example, urination on the clean roll, etc.).

However, a toilet seat with a paper cover has been disclosed, said cover being windable off a supply roll and onto a takeup roll by a drive, whereby a foot pedal or motor serves as the drive (German Utility Model No. 7,000,474). In this embodiment, the paper is stored on the supply roll on one side of the seat. The paper strip is pulled over the seat and attached to the takeup roller on the other side. Before the seat is used, the takeup roller is turned and a new section of the paper strip is pulled across the seat.

All of these known toilet seat covers of this type, in the form of a strip of plastic or paper, suffer from the considerable disadvantage that they can slide off the toilet seat or become crumpled when the user makes the slightest movement, or can remain stuck to the sides of the seat, so that the use of a toilet protected in this manner offers only very limited hygienic protection.

SUMMARY OF INVENTION

An object of the present invention is to overcome deficiencies in the prior art such as noted above.

Another object is to provide an arrangement of the type described which is simple and hygienically reliable, the arrangement being simple to operate, being foolproof in function, and being easily replaceable.

BRIEF DESCRIPTION OF DRAWING

Other objects and the nature and advantage of the instant invention will be more apparent from the following description of non-limitative, illustrative embodiments, described in conjunction with the drawing, wherein:

FIG. 18 is a cross section similar to FIG. 6 along line XVIII—XVIII in FIG. 2;

FIG. 19 is a cross section through the rear part of an arrangement in an embodiment protected against dripping water, along line XIX—XIX of FIG. 2;

FIG. 20 is a cross section through another version of a toilet seat with a tubular cover according to FIG. 6;

FIG. 21 is a top view of a toilet seat with portions of its outer contours convex, in a purely schematic representation;

FIG. 22 is a cross section similar to FIG. 4, but with a disposable container.

DETAILED DESCRIPTION OF EMBODIMENTS

Figure 1:
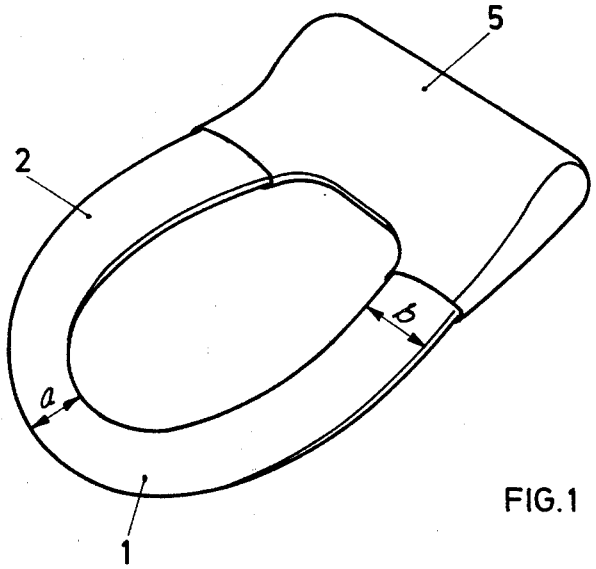
FIG. 1 is a perspective view of an arrangement for fitting and changing a tubular cover on a toilet seat.

FIG. 1 shows an arrangement designed as an interchangeable unit, with a toilet seat and cover. This unit consists of a toilet seat 1, covered by a tube 2, preferably of plastic film. Both ends 3 and 4 of the toilet seat 1 project into a housing 5, such housing also comprising a closed but disassemblable unit, as described below. In the embodiment shown, the toilet seat is narrower at its forward curved part than at the two sides ($a<b$).

Figure 2:
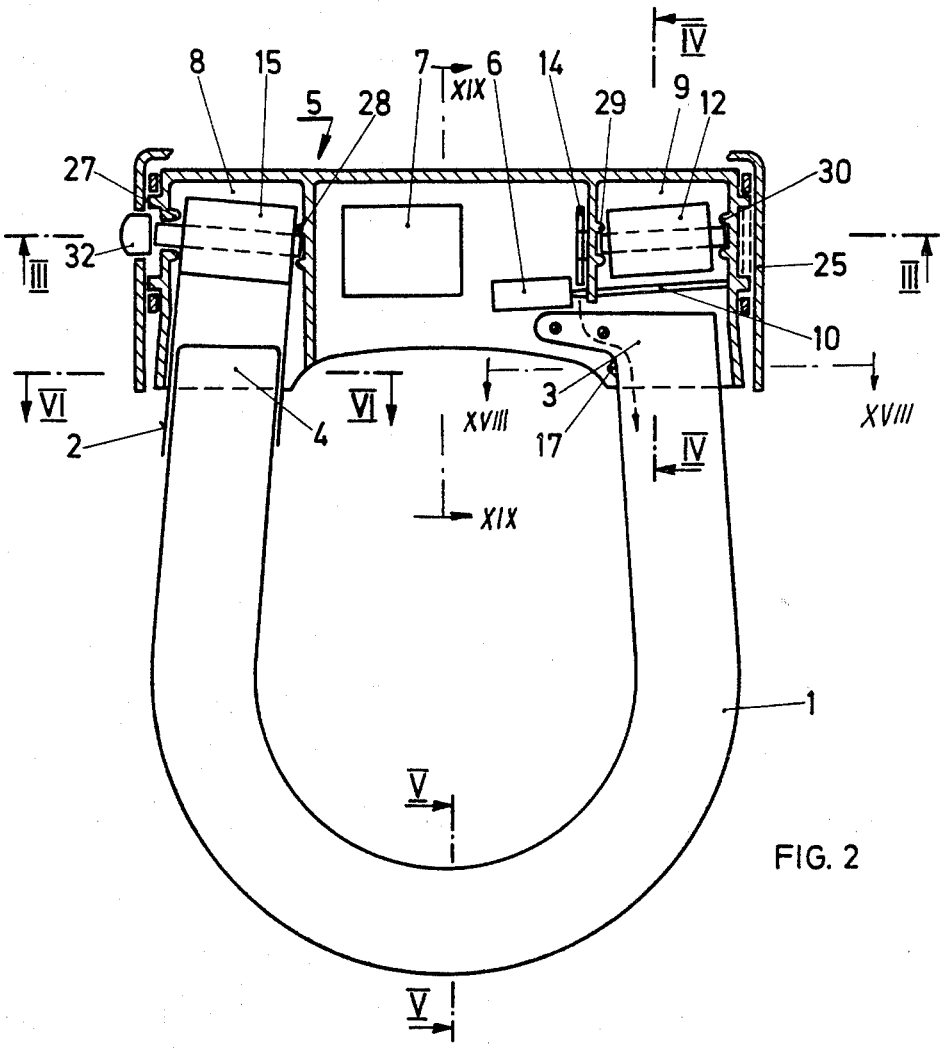
FIG. 2 is a top view of the arrangement according to FIG. 1, with the rear part cut away.
Figure 3:
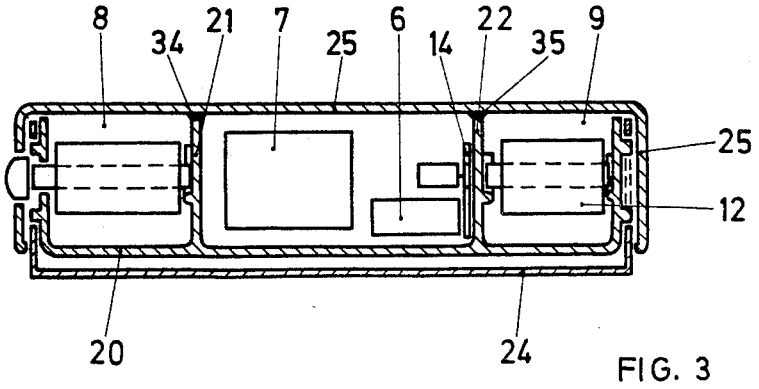
FIG. 3 is a cross section through the rear part along line III—III in FIG. 2.
Figure 4:
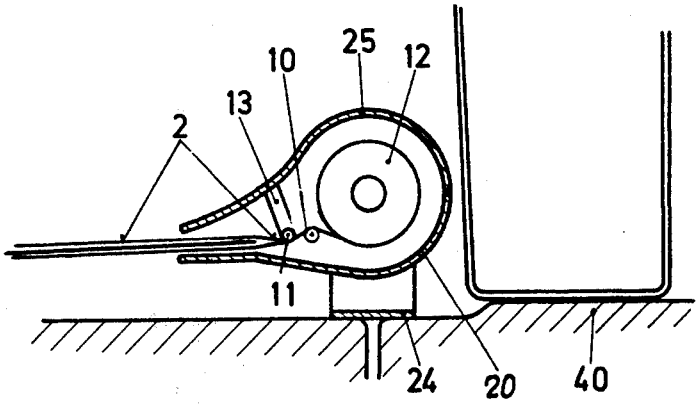
FIG. 4 is a section similar to FIG. 3, along line IV—IV in FIG. 2.

FIG. 2 shows the toilet seat 1 with tube 2, as well as the two ends 3 and 4 of the toilet seat 1 projecting into the interior of the housing 5. This housing 5 also contains an electric motor 6 with a replaceable battery 7 as a power source, as well as a tubular film container 8 and/or 9 located on the left and/or right. The box 9 is also provided with a driven conveying roller 10 and a guide roller 11 (FIG. 4) mounted on a support arm 13. A reel 12 is used to wind up the used tube 2. The motor 6 drives a gear train 14, to whose output the conveying roller 10 and reel 12 are coupled. The unused tube 2 is unwound from a reel 15, contained in the film container 8. A cutter 17, with an obtuse cutting angle, mounted at the end 3 of toilet seat 1, serves to slit the tube 2 in order to allow it to be pulled off and wound up on the reel 12.

Figure 23:
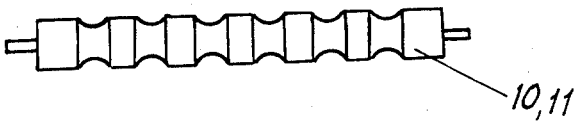
FIG. 23 is a guide roller with transverse grooves, shown in a side view.

In order to smooth the cut tube, which may have creases in it, one or both rollers 10 and/or 11 are preferably provided with individual transverse grooves, as shown in FIG. 23, the presence of which provides this important advantage. The housing 5 comprises a first housing cover 20 having partitions 21 and 22 which delimit the film containers 8 and 9 on their inner sides, and a second cover 25 which fits over the first cover 20. The partitions 21 and 22 can be provided with seals 34 and 35 where they contact the second cover 25 to protect the interior of the housing from the dripping water.

Figure 5:
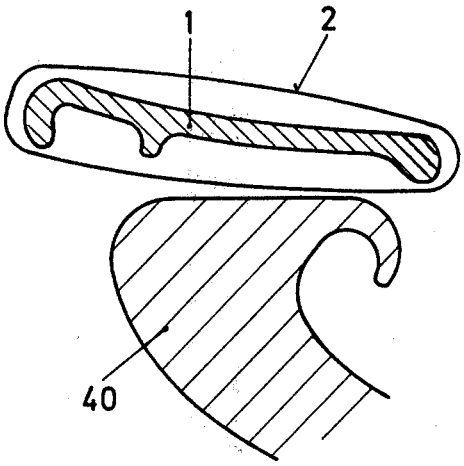
FIG. 5 is a cross section through the toilet seat along line V—V in FIG. 2, with a portion of the toilet bowl cut away.
Figure 6:
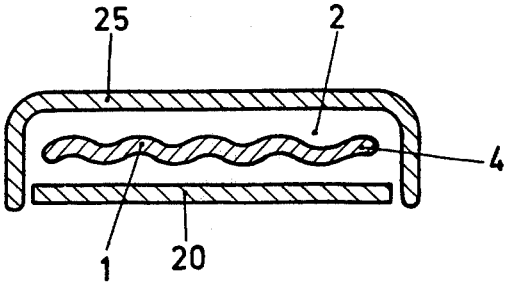
FIG. 6 is a cross section along line VI—VI in FIG. 2.

As FIG. 5 shows, it is highly advantageous to make the upper surface of toilet seat 1 concave and to round off the inner and outer contours in such manner that tube 2, as clearly shown in FIG. 5, in practice rests against only boundary areas of the toilet seat 1. Consequently, the minimum contact surface and frictional area considerably facilitate its advance. Basically, it is possible, as shown in FIG. 20, to provide an air duct with holes through which air is blown, serving to lift tube 2 off toilet seat 1 as it is advanced and to reduce the drag, i.e. to reduce the friction between the toilet seat 1 and and tube 2. Likewise, as shown in FIGS. 6 and 21, the shape of the surface of the toilet seat, which can be provided with corrugations, serves to facilitate its advance.

Figure 7:
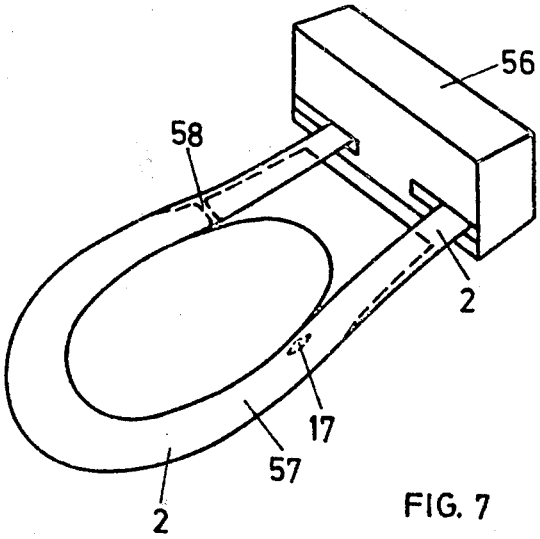
FIG. 7 is another embodiment of an arrangement as shown in FIG. 1.

FIG. 7 shows a film container 56, from which a protective tube 2, preferably a film tube made of plastic, is pulled out in the manner previously described, from the film container 56 on the left hand side of the figure. The rear left part of a toilet seat 57 is cut through by a slot 58. This makes it possible to push the tube 2 into the slot 58 and then over the forward part of toilet seat 57, whereby the front part of seat 57 is then covered by the tube 2. In order to permit the tube to be pulled off toilet seat 57 at the other end, tube 2 must be slit as it is pulled off, e.g. using the blade 17.

This design is extremely simple. It can easily be mounted on existing facilities. Designing slot 58 appropriately minimizes the resistance to movement of the tube 2. This design is especially suited for locations with a high use frequency.

Figure 8:
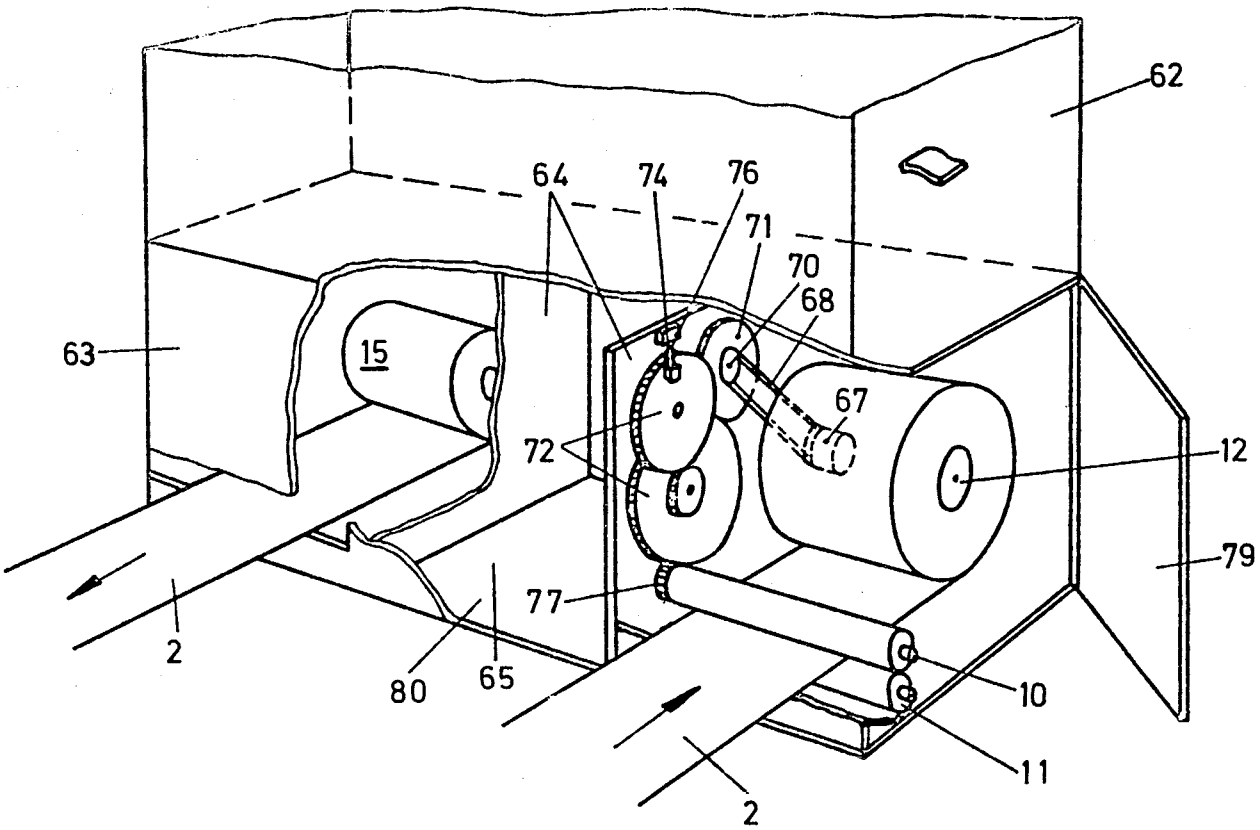
FIG. 8 is a section of the film container in a perspective view, with parts cut away, for an arrangement according to FIG. 7.
Figure 9:
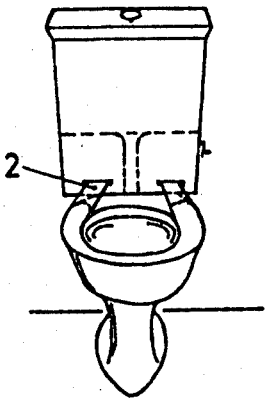
FIGS. 9–14 are schematic representations of toilet bowls and toilet seats, with different guides for plastic films for partially covering toilet seats.
Figure 10:
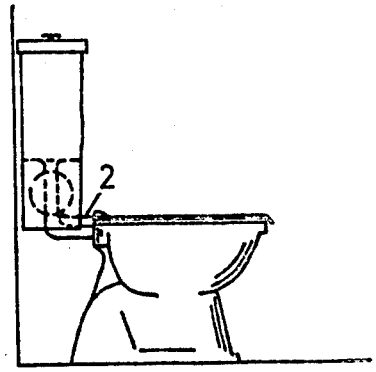
Figure 11:
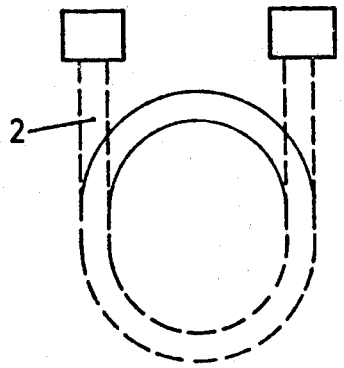
Figure 12:
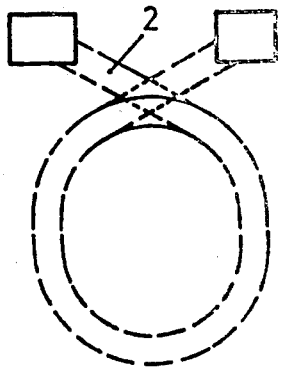
Figure 13:
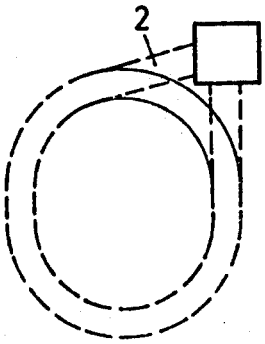
Figure 14:
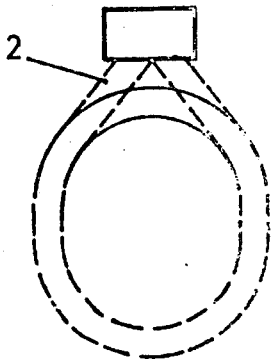

FIG. 8 is a perspective drawing, with parts shown cut away, of the lower part of a flush tank 62 with a tubular film container 63 attached, having a bottom 80. The latter is divided by two partitions 64 which support the drive mechanism to move tube 2 and to form a chamber 65 for an electric motor (not shown in FIG. 8). The supply roll with reel 15 is visible at the left side of the figure, while the right side shows the takeup roll with reel 12. The shaft of the reel 12 is provided with a pulley 67, and a belt 68 being connected to a second pulley 70. This second pulley is connected to a drive gear 71. This gear 71 meshes with two gears 72, the upper of these gears being provided with a stop pin 74, fastened in a spring-tensioned manner, for example. This pin cooperates with a limit switch 76 located in an appropriate position in order to interrupt the rotational movement and/or takeup of the tube 2 when a motor-drive takeup is provided. The lower of the gears 72 drives a pinion 77 and hence conveying roller 10. Guide roller 11 can also be driven. The film strip and/or tube 2 is pulled between the two rollers 10 and 11 when it is wound up. A side wall 79, as shown in FIG. 8, can be opened sideways to permit the tube 2 to be replaced easily. The side wall opposite side wall 79 can also be swung out with reel 15 to permit easier access to the roll.

The number of gear teeth and/or dimensions of the gear drive are selected so that one rotation of the upper gear 72 corresponds to one complete replacement of the tube 2 on the toilet seat.

FIGS. 9–14 show various possibilities for guiding the tube 2 as well as arrangements of the film container, whereby, however, the basic principle, namely complete covering of the front part of the toilet seat, is the same and is complete in all embodiments.

Figure 15:
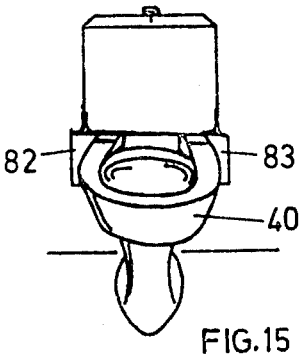
FIGS. 15–17 are arrangements for mounting on existing toilets.
Figure 16:
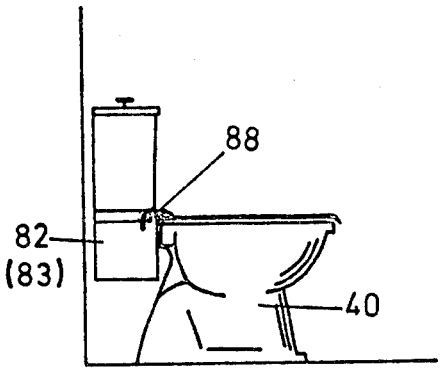
Figure 17:
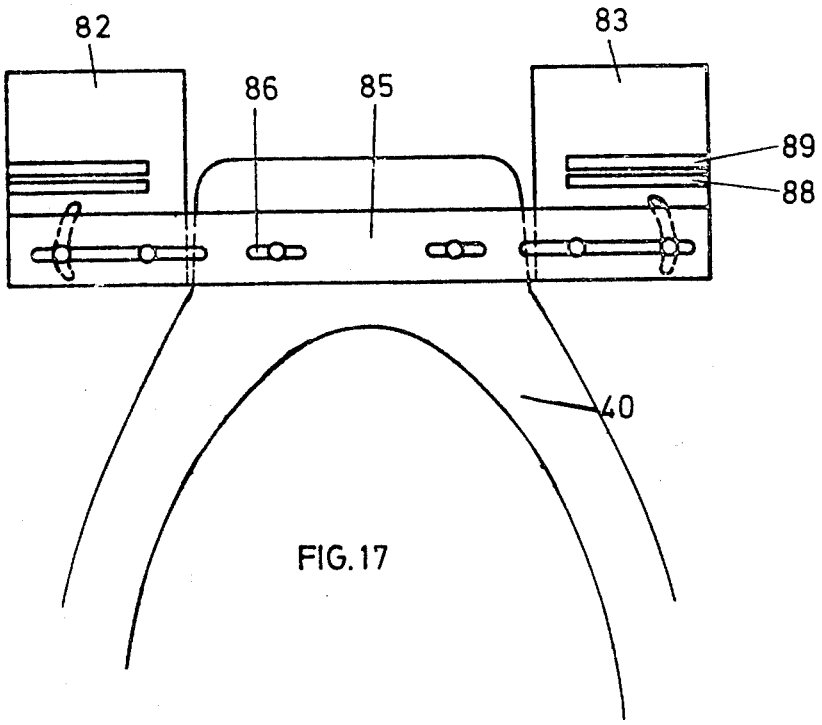

FIGS. 15–17 show in a purely schematic fashion how a dispensing station 82 and a takeup station 83 can be mounted in the manner described hereinabove on the existing toilet in simple fashion. It is possible, for example, as shown in detail in FIG. 17, to connect the dispensing station 82 and takeup station 83 by a support 85 provided with two slots 86 between the two stations 82 and 83, the width of the slots corresponding to the diameter of the two openings in the toilet bowl which serve to mount the cover. In this manner, the support 85 can easily be fastened onto the toilet bowl 40 by using the same fastening device used for the cover. The two stations 82 and 83 are fastened to the support 85 in such manner that they are laterally adjustable and swivelable. In FIG. 17, one guide roller 88 to guide tube 2 is provided in each station 82 and 83, said tube entering and emerging through appropriate slots 89 in the two stations.

FIG. 18 shows a cross section through the design according to FIG. 2 combined with another design for a toilet seat profile, provided on the inner edge with a hollow rib 48, serving as an air duct. Blade 17 is shown on the outer edge, as well as a seal 46. Housing cover 25 is extended along its outer edge to form a drip guard 45.

FIG. 19 shows a practically water-tight design for a housing according to FIG. 2, consisting essentially of the above-mentioned parts, namely, a housing shell 20 with a continuous cover 36 provided with seals 34 and 35 at the contact points. The cover 25 is likewise provided with a seal 46 in the vicinity of drip guard 45, whereby the interior of the housing with battery 7 and electric motor 6 is especially well protected.

FIG. 20 shows another profile for a toilet seat 1, the seat having a concave upper surface and an interior chamber 50 with vents 51. These vents make it possible to lift the upper portion of the tube 2 off toilet seat 1 in the critical areas. Here, compressed air can be obtained from a blower driven by the electric motor 6.

FIG. 22 shows a housing design with a disposable container 42 which accepts the takeup reel 12 with the used tube 2; the disposable container 42 is lifted out as a unit after raising the cover 25, and the material can be reused as raw material, or it can be destroyed. This disposable container 42 has a slot at the front to accept the tubular film, but can be made in two parts or hinged. Support arm 13 for guide roller 11 is mounted on cover 25, so that after cover 25 is in place, this arm can perform the guide function shown in FIG. 22. It has been found that mounting the rollers 10 and 11 at approximately the same height (see FIG. 4) has the advantage that any liquid carried along with the tube cannot drip off, but is wrapped up with the tube. The axial spacing of the rollers is also made so that any material soiling the tube will not be squeezed.

Finally, the arrangement described allows the toilet seat on a toilet to be covered with a plastic tube by pushing a button or actuating a lever. An important element of this arrangement is the fastening frame 24, which constitutes the connecting element between the toilet bowl 40 and the rest of the arrangement and serves as an adjustable mounting base. The housing shell 20, preferably made of plastic like the rest of the housing parts, forms the lower half of the housing 5. On one side, shell 20 is provided with reel bearings 27 and 28 to accept the clean tube on reel 15 and on the other side is provided with reel bearings 19 and 20 to accept the used reel 12 to take up the slit tube. The chamber 65 therebetween, delimited by walls 21 and 22, serves to accept the drive and the power source. This intermediate chamber can be sealed separately so that it is impervious to dripping water by using an appropriate cover 36 with sealing strips. Housing shell 20 is swivelably mounted in fastening frame 24.

The cover 25 of housing 5, likewise preferably made of plastic, can be designed as a cover resistant to dripping water and to theft. It can also be used to display operating and maintenance instructions as well as trademarks and the like. The toilet seat 1 is a horseshoe-shaped plastic part mounted on the side of the housing shell 20 on which the used roll is mounted. The replaceable blade 17, used to cut the plastic tube, is mounted at an obtuse angle in the cutting direction, in other words, it has a cutting angle of more than 90°. For safety reasons, the blade is mounted inside the housing, i.e., it is not exposed.

The following variations are also possible:

The toilet seat can be made detachable and, e.g., multipartite. Instead of a closed tube, a folded film can be used, the film being joined to form a tube by welding or gluing after being dispensed from reel 15.

A bactericide, e.g., hexachlorophene, iodine, formalin, or the like can be added to the tube material and/or the housing material.

It is also possible to irradiate the tube with ultraviolet light before use.

Appropriate lubricants can be used to make the contact between the toilet seat and the tube more slippery. The drive roller and possibly the guide roller can be roughened by providing them with grained outer surfaces and they can be grooved, for example, to prevent jamming.

The toilet seats are interchangeable. Control can be by means of an electric eye. The device can be installed as follows:

The end of the tubular plastic film, stored in the housing and wound up flat on one roll, is slipped over the free end of the toilet seat when the housing is opened; the tube is then pulled over the entire horseshoe-shaped seat and over the blade. The tube, thus slit laterally, is placed over the takeup roller of the drive, preferably coated with carborundum grains, and attached to the empty reel whose surface can be gummed with adhesive. The reel is then inserted from above into its bearing. A battery or line connection can serve as a power source.

When the device is connected to the line, where sufficient energy and power are available, it is basically possible to eliminate the drive roller and to pull the tube along using the takeup roller. In this case, a photocell is advantageously used to control the amount pulled off.

In order to ensure that the used tubing is wound up tight, a friction clutch can be built into the supply roller drive. The S-shaped part provided for the slit tubular film ensures a good fit and hence protection against slippage. Then the cover is put in place and locked firmly using a key lock, for example. By pressing the push button switch or moving a lever, the tube is moved along the toilet seat until the latter is completely covered with a new section of tube. This makes it possible to raise the toilet seat a few centimeters off the front edge of the toilet bowl to facilitate this movement, especially when the tube is inflated, to prevent the inflated tube from coming in contact with the edge of the toilet seat and thereby encountering increased resistance to its movement. A cam in the drive can be used to control this lifting action.

A cam disk can likewise control the operating time of the motor as a function of the rpm of the drive roller, whereby a delay element can be provided to protect against an immediate further advance, i.e., by someone pushing the button again.

An arrangement of this kind is not only extremely simple and hence operationally reliable, but relatively inexpensive. It provides every user with a clean seat. Appropriate shapes and especially a careful selection of material for the tube and seat permit minimum friction between the two, and ensure that the tube will be advanced each time. This choice of material will also prevent electrostatic charges from building up on either the tube or the toilet seat.

It is also possible, however, to form the tube immediately before it is placed on the toilet seat and to provide a welding station or a gluing station for the purpose.

In this manner, it is reliably possible to cover the toilet seat for each user anew, with no danger that this movement will eventually result in the user sitting on an uncovered seat, a situation which the above designs are basically intended to avoid.

The embodiments described are simple in structure and therefore functional. They can also be mounted easily on existing toilets. Since the space available is such that the tubing supply is sufficient for at least 100 to 300 changes, unacceptably frequent replacement and loading of a new tube in the dispensing station of the film container is unnecessary.

It will be obvious to those skilled in the art that various changes may be made without departing from the scope of the invention and the invention is not to be considered limited to what is shown in the drawings and described in the specification. For example, it will be understood that a tube of paper, e.g. glassine paper or the like, may be used in place of the tubular plastic film as a covering medium.

What is claimed is:

1. A device for supplying a tubular cover on a toilet seat comprising a toilet seat having gap means through which the tubular cover is passed to encircle the body of the toilet seat, reel means to store a length of tubular cover material, said reel means comprising a storage reel of unused tubular cover material located at the back end of the toilet seat, a take-up reel for used cover material which has passed the length of the toilet seat, drive means to advance the cover material a predetermined length corresponding to the length of the toilet seat covered; and protective housing means to cover said drive means, said storage reel and said take-off reel.

2. A device according to claim 1, wherein said toilet seat having gap means comprises a toilet seat having a slot on one side through which the tubular cover is passed, whereby the end of the seat facing the slot is threaded into the tubular cover.

3. A device according to claim 1, further comprising a blade 17 mounted at an obtuse angle in the direction in which the tube cover is pulled on the toilet seat immediately upstream from the takeup reel to slit the cover.

4. A device according to claim 1, wherein said drive means, said storage reel and said takeup reel constitute a unit mountable on a toilet bowl near the back portion of the toilet seat below the flush tank.

5. A device according to claim 1, wherein said toilet seat having gap means comprises a toilet seat having a free end over which the tubular cover is passed.

6. A device for supplying a tubular cover on a toilet seat comprising a toilet seat having gap means through which the tubular cover is passed to encircle the body of the toilet seat, reel means to store a length of tubular cover material, said reel means comprising a storage reel of unused tubular cover material located at the back end of the toilet seat, a take-up reel for used cover material which has passed the length of the toilet seat, cutting means to slit the tubular cover material after it has passed the length of said toilet seat, electrical drive means to advance the cover material a predetermined length corresponding to the length of the toilet seat covered; and protective housing means to cover said drive means, said storage reel and said take-off reel, said protective housing constituting a unit mounted at the back portion of said toilet seat.

7. A device according to claim 6, wherein the tubular cover is formed of plastic film.

8. A device according to claim 7, wherein said drive means includes a pair of rollers disposed at essentially the same height near the takeup reel between which pair of rollers the film tube is guided, at least one of said rollers being provided with transverse grooves in order to smooth out creases in the tube.

9. A device according to claim 6, comprising a toilet seat having a reduced width in the forward, curved part.

10. A device according to claim 6, wherein said drive means comprises means to electrically drive said takeup reel.

11. A device according to claim 6, wherein the two ends of the toilet seat over which the tube is drawn, are provided with means to prevent formation of a vacuum and to reduce friction.

12. A device according to claim 11, wherein said means to prevent formation of vacuum and to reduce friction comprises corrugations on the toilet seat.

13. A device according to claim 6, further comprising means provided on the toilet seat to reduce friction between the toilet seat and the tube.

14. A device according to claim 6, wherein the toilet seat is provided with holes in order to loosen the tube sticking to it, and means to provide air pressure through said holes.

15. A device according to claim 6, and wherein said housing consists of plastic containing antibacterial agents.

16. A device according to claim 6, wherein the tube consists of a plastic containing an antibacterial agent.

17. A device according to claim 10, further comprising a disposable container surrounding said takeup reel.

18. A device according to claim 6, wherein the toilet seat is provided with a concave upper surface.

19. A device according to claim 6, further comprising means to irradiate the tube with ultraviolet light before use.

20. A device according to claim 6, wherein said drive means comprises a series of gears, an electric motor for driving at least one of said gears, and battery mounting means for holding a battery for driving said electric motor.

21. A device for supplying a tubular cover of synthetic film material on a toilet seat comprising a toilet seat having gap means through which the tubular cover is passed to encircle the body of the toilet seat, reel means to store a length of tubular cover material, said reel means comprising a storage reel of unused tubular cover material located at the back end of the toilet seat, a take-up reel for used cover material which has passed the length of the toilet seat, and drive means to advance the cover material of predetermined length corresponding to the length of the toilet seat covered and comprising cutting means for slitting the tubular cover immediately upstream from the take-up reel and a pair of rollers placed downstream from said cutting means near the take-up reel, between which pair of rollers the film tube is guided.

* * * * *